US011953004B2

(12) United States Patent
Nishikawa et al.

(10) Patent No.: US 11,953,004 B2
(45) Date of Patent: Apr. 9, 2024

(54) COMPRESSOR AND METHOD FOR MANUFACTURING COMPRESSOR

(71) Applicant: DAIKIN INDUSTRIES, LTD., Osaka (JP)

(72) Inventors: Sayumi Nishikawa, Osaka (JP); Yasuo Mizushima, Osaka (JP); Yoshitomo Tsuka, Osaka (JP); Yukiko Maejima, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 18/112,620

(22) Filed: Feb. 22, 2023

(65) Prior Publication Data

US 2023/0204031 A1 Jun. 29, 2023

Related U.S. Application Data

(63) Continuation of application No. PCT/JP2021/025350, filed on Jul. 5, 2021.

(30) Foreign Application Priority Data

Aug. 25, 2020 (JP) ..... 2020-141949

(51) Int. Cl.
*F04C 18/02* (2006.01)
*B23K 26/21* (2014.01)
(Continued)

(52) U.S. Cl.
CPC .... *F04C 18/0215* (2013.01); *F04C 2230/231* (2013.01); *F04C 2240/30* (2013.01)

(58) Field of Classification Search
CPC ..... F04C 18/0215; F04C 18/0253; F04C 23/008; F04C 2230/231; F04C 2240/30; B23K 26/244; B23K 26/21
See application file for complete search history.

(56) References Cited

U.S. PATENT DOCUMENTS

2011/0200471 A1 8/2011 Kato et al.
2016/0348677 A1 12/2016 Nakano et al.
(Continued)

FOREIGN PATENT DOCUMENTS

JP 2011-169229 A 9/2011
JP 2017-25762 A 2/2017
(Continued)

OTHER PUBLICATIONS

Englsih translaiton of KR20130052323 by PE2E Sep. 6, 2023.*
(Continued)

*Primary Examiner* — Deming Wan
(74) *Attorney, Agent, or Firm* — Global IP Counselors, LLP

(57) ABSTRACT

A compressor includes a casing, a housing inside the casing, and first and second welds. The casing includes a tubular barrel casing and an end casing. The first weld welds the barrel casing and the housing together. The second weld welds the barrel casing and the end casing together along a circumferential direction. The second weld includes a repeatedly welded portion formed by one end portion and an other end portion of the second weld overlapping each other, or the second weld includes a plurality of second welds each including a repeatedly welded portion formed by an end portion of the second weld and an end portion of an other one of the second welds overlapping each other. The repeatedly welded portion are formed to reduce deformation of the barrel casing. The repeatedly welded portion and the first weld are aligned along an axial direction of the barrel casing.

19 Claims, 8 Drawing Sheets

(51) Int. Cl.
*B23K 26/24* (2014.01)
*F04C 23/00* (2006.01)

(56) References Cited

U.S. PATENT DOCUMENTS

2017/0232553 A1* 8/2017 Sievi ..... B23K 26/0643
219/121.64
2018/0066700 A1* 3/2018 Kozuma ..... F25B 31/002

FOREIGN PATENT DOCUMENTS

KR 20130052323 A * 6/2011 ..... B23K 26/21
WO 2015/111267 A1 7/2015

OTHER PUBLICATIONS

International Preliminary Report of corresponding PCT Application No. PCT/JP2021/025350 dated Mar. 9, 2023.
International Search Report of corresponding PCT Application No. PCT/JP2021/025350 dated Aug. 3, 2021.
European Search Report of corresponding EP Application No. 21 86 0980.8 dated Nov. 9, 2023.

* cited by examiner

COMPRESSOR AND METHOD FOR MANUFACTURING COMPRESSOR

CROSS-REFERENCE TO RELATED APPLICATIONS

This is a continuation of International Application No. PCT/JP2021/025350 filed on Jul. 5, 2021, which claims priority to Japanese Patent Application No. 2020-141949, filed on Aug. 25, 2020. The entire disclosures of these applications are incorporated by reference herein.

BACKGROUND

Technical Field

The present disclosure relates to a compressor and a method for manufacturing a compressor.

Background Art

A scroll compressor for compressing a refrigerant has been known in the art (for example, Japanese Unexamined Patent Publication No. 2017-25762).

A scroll compressor described in Japanese Unexamined Patent Publication No. 2017-25762 includes a compression mechanism, a crankshaft, a housing, and a casing. The compression mechanism sucks and compresses a low-temperature and low-pressure refrigerant gas, and discharges the compressed refrigerant that is the refrigerant gas with high temperature and high pressure. The crankshaft transfers torque to the compression mechanism. The housing rotatably supports the crankshaft. The casing houses the compression mechanism, the crankshaft, and the housing. The casing includes a barrel casing, an upper wall, and a bottom wall. The upper wall is welded to an upper end of the barrel casing. The bottom wall is welded to a lower end of the barrel casing. The housing is tack-welded to the barrel casing.

SUMMARY

A first aspect of the present disclosure is directed to a compressor. The compressor includes a casing, a housing provided inside the casing, a first weld, and a second weld. The casing includes a tubular barrel casing and an end casing covering an opening of an end portion of the tubular barrel casing. The first weld is formed by welding the tubular barrel casing and the housing together. The second weld is formed by welding the tubular barrel casing and the end casing together over a predetermined length along a circumferential direction of the tubular barrel casing. The second weld includes a repeatedly welded portion formed by one end portion and an other end portion of the second weld overlapping each other, or the second weld includes a plurality of second welds each including a repeatedly welded portion formed by an end portion of the second weld and an end portion of an other one of the second welds overlapping each other. The repeatedly welded portion are formed to reduce deformation of the tubular barrel casing. The repeatedly welded portion and the first weld are aligned along an axial direction of the tubular barrel casing.

DETAILED DESCRIPTION OF EMBODIMENT(S)

Figure 1:
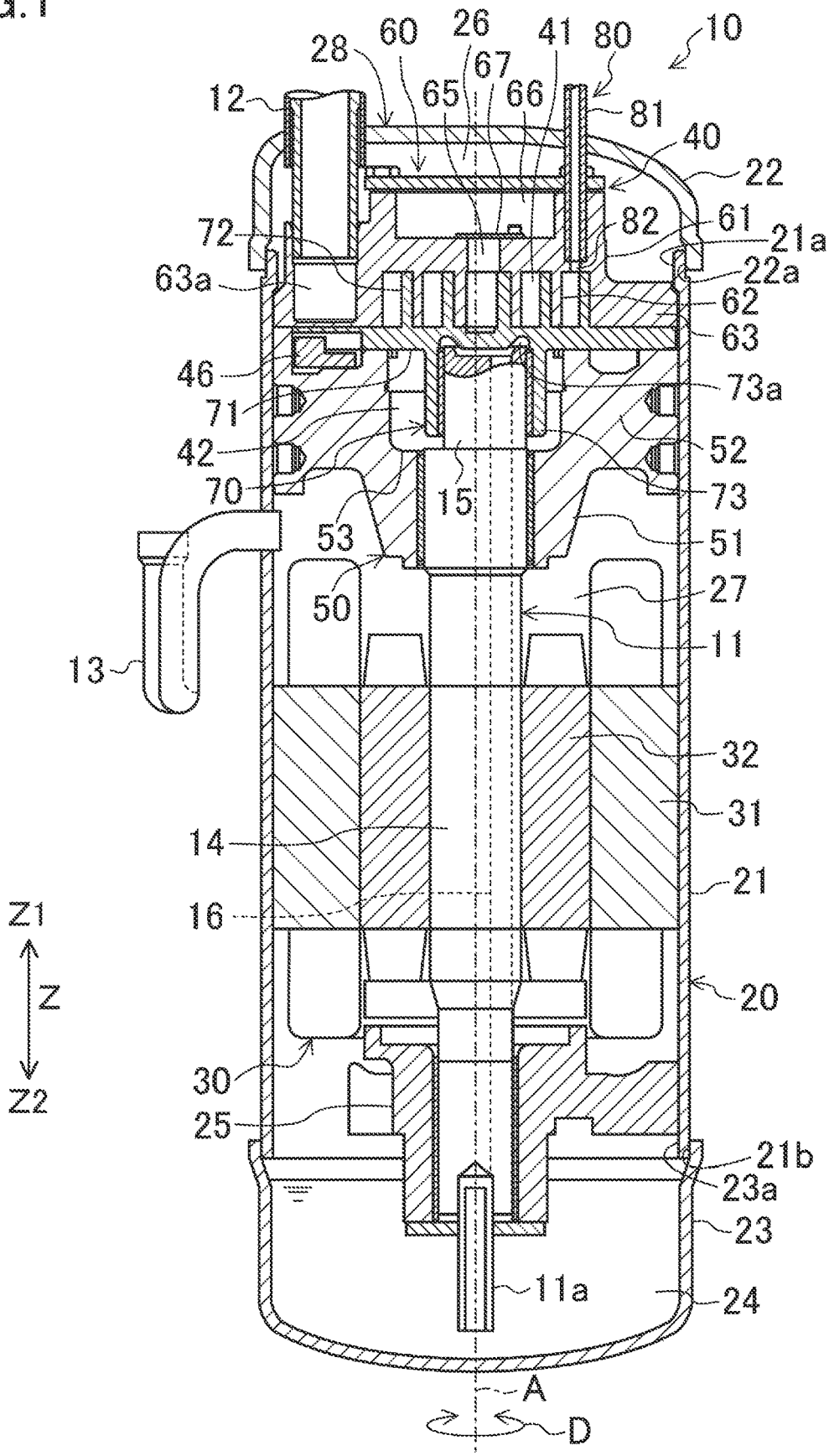
FIG. 1 is a cross-sectional view of a scroll compressor according to an embodiment of the present invention.

A scroll compressor (10) that is an example of a compressor of the present invention will be described with reference to FIG. 1. FIG. 1 is a cross-sectional view of the scroll compressor (10) according to an embodiment of the present invention. The scroll compressor (10) is provided in a refrigerant circuit (not shown) of a vapor compression refrigeration cycle, and compresses a refrigerant serving as a working fluid. In the refrigerant circuit, the refrigerant compressed by the scroll compressor (10) is condensed by a condenser, decompressed by a decompression mechanism, evaporated by an evaporator, and sucked into the scroll compressor (10).

As illustrated in FIG. 1, the scroll compressor (10) includes a casing (20), an electric motor (30), a compression mechanism (40), and a housing (50).

The casing (20) houses the electric motor (30), the compression mechanism (40), and the housing (50). The casing (20) has a vertically oriented cylindrical shape, and is configured as a closed dome. The casing (20) is a metal member. The casing (20) includes a barrel casing (21), a first end casing (22), and a second end casing (23).

The barrel casing (21) is a cylindrical member with both ends open. In this embodiment, the scroll compressor (10) is installed such that the axial direction (Z) of the barrel casing (21) is parallel to the top-to-bottom direction (vertical direction). The axial direction (Z) of the barrel casing (21) is the direction in which the axis (A) of the barrel casing (21) extends. The axis (A) of the barrel casing (21) is a phantom line passing through the centers of openings (21*a*) and (23*a*) at both ends of the barrel casing (21). In this embodiment, one side (Z1) in the axial direction (Z) of the barrel casing (21) is directed upward, and the other side (Z2) in the axial direction (Z) of the barrel casing (21) is directed downward.

The first end casing (22) is a bowl-shaped member having an opening (22*a*) at its lower end. The first end casing (22) is provided at the upper end of the barrel casing (21). The opening (21*a*) at the upper end of the barrel casing (21) is inserted into the opening (22*a*) at the lower end of the first end casing (22). The first end casing (22) is hermetically welded to an upper end of the barrel casing (21) so as to cover the opening (21*a*) at the upper end of the barrel casing (21). The first end casing (22) is an example of an end casing of the present invention. The second end casing (23) is a bowl-shaped member having an opening (21*b*) at its upper end. The second end casing (23) is provided at the lower end of the barrel casing (21). The opening (23*a*) at the lower end of the barrel casing (21) is inserted into the opening (21*b*) at the upper end of the second end casing (23). The second end casing (23) is hermetically welded to a lower end of the barrel casing (21) so as to cover the opening (23*a*) at the lower end of the barrel casing (21).

The electric motor (30) includes a stator (31) fixed to the casing (20) and a rotor (32) inside the stator (31). A drive shaft (11) runs through, and is fixed to, a central portion of the rotor (32). The electric motor (30) is connected to a power source via an inverter device, and is configured to make the number of revolutions (operation frequency) thereof variable.

The second end casing (23) has an oil reservoir (24) for storing lubricant. A suction pipe (12) runs through an upper portion of the first end casing (22) to introduce the refrigerant in the refrigerant circuit into the compression mechanism (40). A discharge pipe (13) runs through a middle portion of the barrel casing (21).

The pressure of the high-pressure refrigerant in the casing (20) acts on the lubricant in the oil reservoir (24). The discharge pipe (13) is connected to the barrel casing (21), and the suction pipe (12) and an injection pipe (81) are connected to the first end casing (22). Furthermore, the housing (50) located above the electric motor (30) and the compression mechanism (40) located above the housing (50) are fixed to the barrel casing (21).

The drive shaft (11) extends in the top-to-bottom direction along the axis (A) of the barrel casing (21). The drive shaft (11) includes a main shaft portion (14) and an eccentric portion (15) formed at the upper end of the main shaft portion (14). The main shaft portion (14) has an upper portion running through the housing (50) and rotatably supported by an upper bearing (51) of the housing (50). The main shaft portion (14) has a lower portion rotatably supported by a lower bearing (25). The lower bearing (25) is fixed to the inner peripheral surface of the barrel casing (21).

An oil pump (11*a*) is coupled to a lower end of the drive shaft (11). The oil pump (11*a*) transfers oil in the oil reservoir (24) upward. The oil is supplied to the bearings (25, 51) and sliding portions of the compression mechanism (40) via an oil supply path (16) of the drive shaft (11).

The housing (50) supports the drive shaft (11). The housing (50) is located above the electric motor (30). The compression mechanism (40) is located above the housing (50). The housing (50) is fixed to the barrel casing (21). The interior of the casing (20) is partitioned into a lower space (27) below the housing (50) and an upper space (26) above the housing (50). The lower space (27) houses the electric motor (30), and the upper space (26) houses the compression mechanism (40). The housing (50) has an annular portion (52) formed as its outer peripheral portion and a recess (53) formed in an upper portion of a central portion thereof.

The compression mechanism (40) includes a fixed scroll (60) installed above the housing (50), and a movable scroll (70) provided between the fixed scroll (60) and the housing (50).

The fixed scroll (60) includes an end plate (61), and a spiral (involute) wrap (62) located on the front face of the end plate (61). The end plate (61) includes an outer peripheral wall (63) located on the outer circumference and continuous with the wrap (62). The end surface of the wrap (62) of the fixed scroll (60) and the end surface of the outer peripheral wall (63) are substantially flush with each other.

The movable scroll (70) includes an end plate (71), a spiral (involute) wrap (72) located on the front face of the end plate (71), and a boss (73) located at a central portion of the back face of the end plate (71). The eccentric portion (15) of the drive shaft (11) is inserted into the internal space (73*a*) of the boss (73), whereby the boss (73) is coupled to the drive shaft (11).

The movable scroll (70) is placed so that the wrap (72) meshes with the wrap (62) of the fixed scroll (60). The compression mechanism (40) has a compression chamber (41) defined by the fixed scroll (60) and the movable scroll (70).

The outer peripheral wall (63) of the fixed scroll (60) has a suction port (63*a*), which is connected to the outflow end of the suction pipe (12). The end plate (61) of the fixed scroll (60) has, at its center, an outlet (65). A high-pressure chamber (66) to which the outlet (65) is open is formed in the back surface of the fixed scroll (60). The high-pressure chamber (66) is provided with a discharge valve (67) for opening and closing the outlet (65). The discharge valve (67) is configured as a reed valve that opens the outlet (65) when the discharge pressure in the compression chamber exceeds a predetermined value. A refrigerant passage (not shown) through which the refrigerant discharged from the high-pressure chamber (66) is sent toward the lower space (27) is formed in the fixed scroll (60) and the housing (50). That is to say, the lower space (27) becomes a high-pressure atmosphere corresponding to the discharge pressure of the refrigerant.

An anti-rotation member (46) of the movable scroll (70) is formed above the annular portion (52) of the housing (50). The anti-rotation member (46) is configured as an Oldham coupling, for example. The Oldham coupling serving as the anti-rotation member (46) is provided on an upper surface of the annular portion (52) of the housing (50), and is slidably fitted to the end plate (71) of the movable scroll (70) and the housing (50).

The scroll compressor (10) has an intermediate pressure introduction path (80). The intermediate pressure introduction path (80) includes an injection pipe (81) and an injection port (82). The injection pipe (81) runs through the end plate (61) of the fixed scroll (60) in the axial direction, and communicates with the injection port (82). That is to say, the intermediate pressure introduction path (80) communicates with the compression chamber (41) of the compression mechanism (40) in the course of compression. The injection pipe (81) is provided with a check valve (not shown). The check valve constitutes a backflow prevention mechanism configured to allow the refrigerant to flow from the injection pipe (81) to the compression chamber (41) and to disallow the refrigerant to flow from the compression chamber (41) of the compression mechanism (40) toward the injection pipe (81).

An operation of the scroll compressor (10) will be described with reference to FIG. 1.

As illustrated in FIG. 1, electric power supplied to the electric motor (30) allows the movable scroll (70) of the compression mechanism (40) to be rotationally driven. Since the rotation of the movable scroll (70) is prevented by the anti-rotation member (46), the movable scroll (70) performs an eccentric motion about the axis of the drive shaft (11). The eccentric motion of the movable scroll (70) causes the volume of the compression chamber (41) to contract toward the center. As a result, the low-pressure refrigerant in the suction pipe (12) flows through the suction port (63*a*) into the compression chamber (41), and is compressed in the compression chamber (41). The refrigerant compressed in the compression chamber (41) is discharged to the high-pressure chamber (66) via the outlet (65). The high-pressure gas refrigerant in the high-pressure chamber (66) flows to the lower space (27) via the path provided in the fixed scroll (60) and the housing (50). The refrigerant in the lower space (27) is discharged outside the casing (20) via the discharge pipe (13).

During operation of the scroll compressor (10), the interior of the lower space (27) is maintained in a high-pressure condition. The high pressure acts on the lubricant in the oil reservoir (24). The lubricant in the oil reservoir (24) flows from the lower end toward the upper end of the oil supply path (16) of the drive shaft (11), and flows out from the opening at the upper end of the eccentric portion (15) of the drive shaft (11) to an internal space (73*a*) of the boss (73) of the movable scroll (70). The oil supplied to the boss (73) lubricates the sliding surface between the boss (73) and the eccentric portion (15) of the drive shaft (11).

Figure 2:
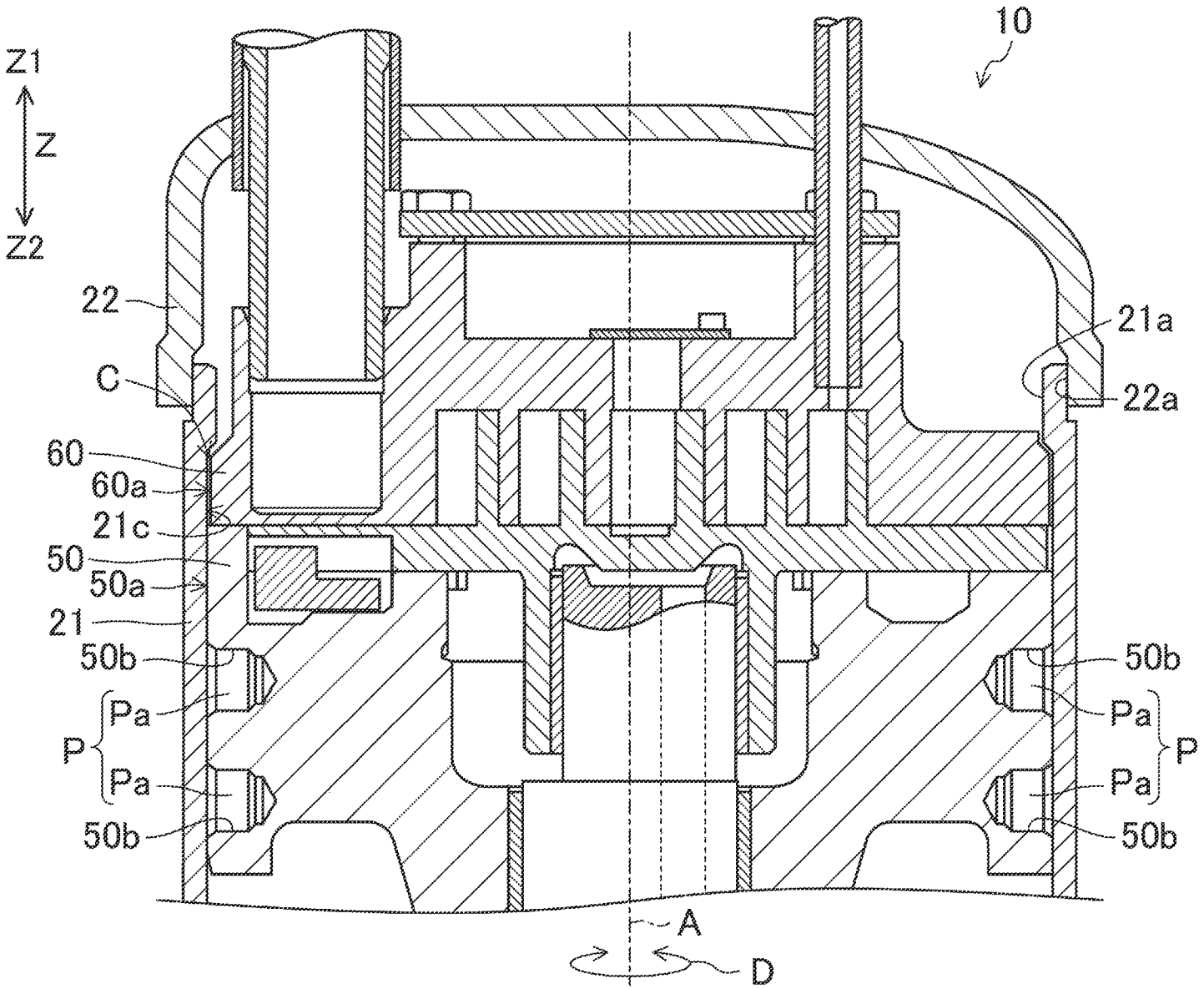
FIG. 2 is a partially enlarged view of the cross-sectional view of the scroll compressor illustrated in FIG. 1.
Figure 3:
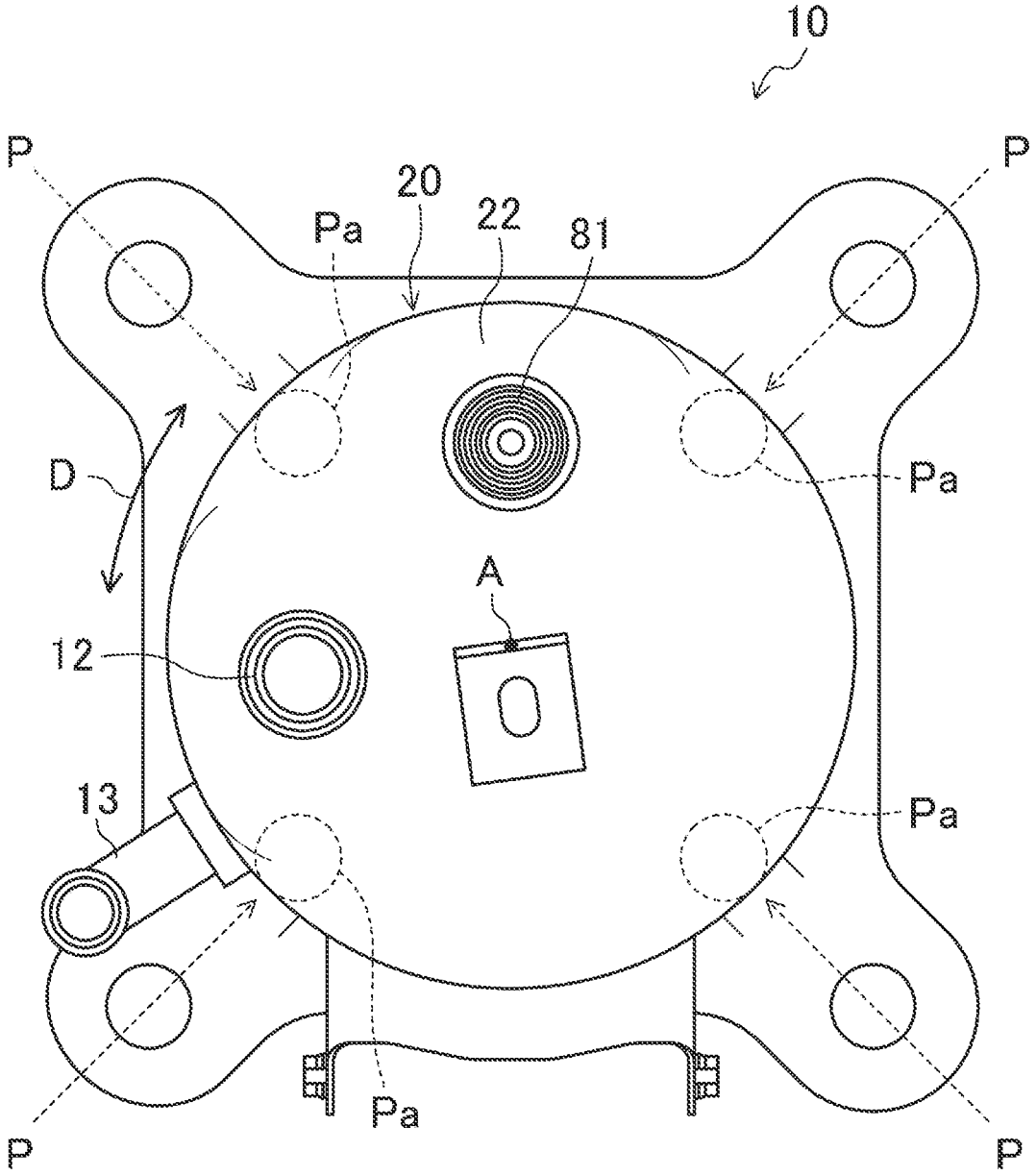
FIG. 3 is a schematic view of the scroll compressor illustrated in FIG. 2 as viewed from an axial direction of a barrel casing.

Next, the configuration of the scroll compressor (10) will be further described with reference to FIGS. 1 to 3. FIG. 2 is a partially enlarged view of the cross-sectional view of the scroll compressor (10) illustrated in FIG. 1. FIG. 3 is a schematic view of the scroll compressor (10) illustrated in FIG. 2 as viewed from the axial direction (Z) of the barrel casing (21).

As illustrated in FIGS. 1 and 2, the first end casing (22) is located on an upper portion of the barrel casing (21). The internal space of the barrel casing (21) is continuous with the internal space of the first end casing (22).

An upper portion of the fixed scroll (60) is located inside the first end casing (22). A lower portion of the fixed scroll (60) is located inside the barrel casing (21). An outer peripheral surface (60*a*) of the lower portion of the fixed scroll (60) faces the inner peripheral surface (21*c*) of the barrel casing (21). A clearance (C) is formed between the outer peripheral surface (60*a*) of the fixed scroll (60) and an inner peripheral surface (21*c*) of the casing (21).

The housing (50) is arranged inside the barrel casing (21). The housing (50) is arranged below the fixed scroll (60). The outer peripheral surface (50*a*) of the housing (50) faces the inner peripheral surface (21*c*) of the barrel casing (21). Recesses are formed in the outer peripheral surface (50*a*) of the housing (50). A welding pin (Pa) is press-fitted into each of the recesses to weld the barrel casing (21) and the housing (50) together. The welding pins (Pa) are made of low carbon steel suitable as a base material for welding, for example.

As illustrated in FIGS. 2 and 3, two or more of the welding pins (Pa) are aligned at equal angular intervals along the circumferential direction (D) of the barrel casing (21). In addition, two or more of the welding pins (Pa) are aligned along the axial direction (Z) of the barrel casing (21).

In this embodiment, the number of the welding pins (Pa) used to weld the barrel casing (21) and the housing (50) together is eight.

As illustrated in FIGS. 2 and 3, in this embodiment, four welding pin groups (P) are aligned at intervals of 90 degrees along the circumferential direction (D) of the barrel casing (21). Each welding pin group (P) includes two of the welding pins (Pa) aligned along the axial direction (Z) of the barrel casing (21).

Figure 4:
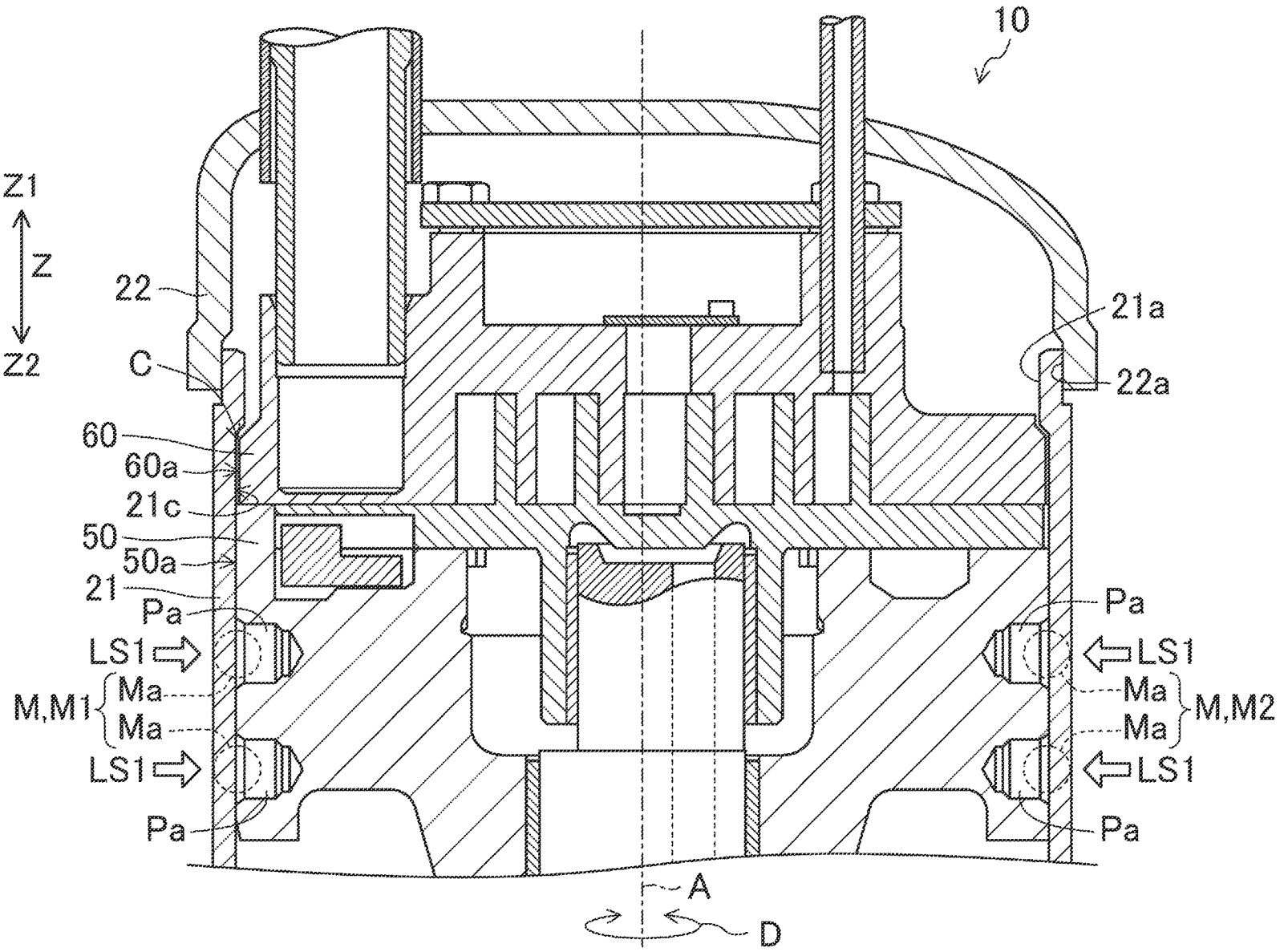
FIG. 4 is a cross-sectional view of a scroll compressor showing a procedure to weld the barrel casing and a housing together.
Figure 5:
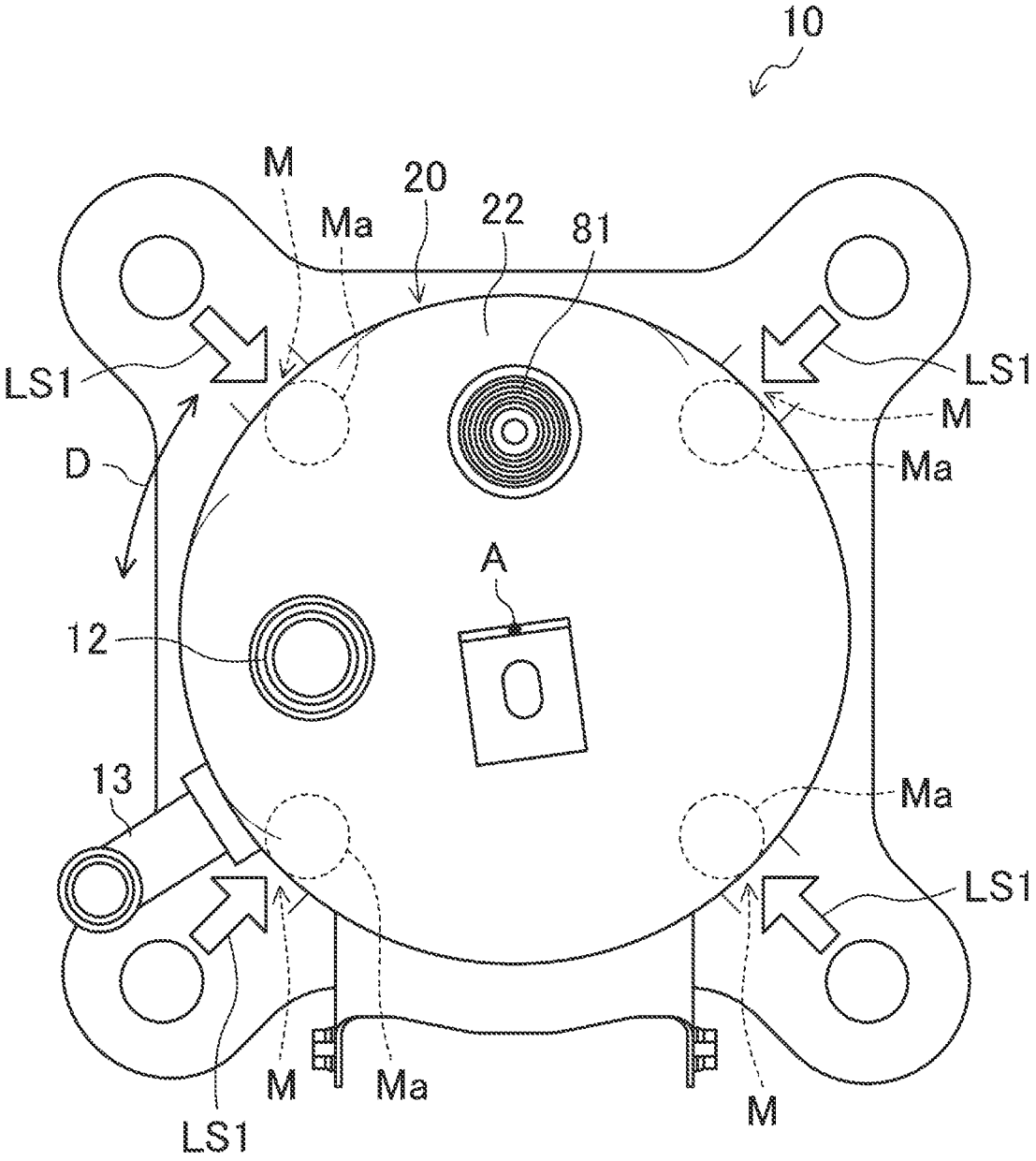
FIG. 5 is a schematic view of the scroll compressor illustrated in FIG. 4 as viewed from the axial direction of the barrel casing.

Next, a procedure to weld the barrel casing (21) and the housing (50) together during manufacture of the scroll compressor (10) will be described with reference to FIGS. 4 and 5. FIG. 4 is a cross-sectional view of the scroll compressor (10) showing a procedure to weld the barrel casing (21) and the housing (50) together. FIG. 5 is a schematic view of the scroll compressor (10) illustrated in FIG. 4 as viewed from the axial direction (Z) of the barrel casing (21).

As illustrated in FIGS. 4 and 5, the welding pins (Pa) are press-fitted into the housing (50), and then the housing (50) is housed inside the barrel casing (21). The electric motor (30) and the drive shaft (11) are previously housed in the barrel casing (21) before the housing (50) is housed in the barrel casing (21). Next, the housing (50) and the barrel casing (21) are positioned so that their positions relative to each other in the axial direction (Z), the circumferential direction (D) of the barrel casing (21), and the radial direction of the barrel casing (21) are similar to those immediately after the completion of the scroll compressor (10) as a product.

While the housing (50) is positioned relative to the barrel casing (21), portions of the barrel casing (21) facing the welding pins (Pa) are irradiated with laser light (LS1) from the outside of the barrel casing (21). The portions of the barrel casing (21) facing the plurality of welding pins (Pa) are each irradiated with the laser light (LS1) in the form of dots. As a result, the barrel casing (21) and the welding pins (Pa) melt and solidify, thereby welding the barrel casing (21) and the housing (50) together.

First welds (Ma) are formed at the locations where the barrel casing (21) and the housing (50) are welded together (the locations irradiated with the laser light (LS1)).

Each of the first welds (Ma) is obtained by solidifying a member molten while the barrel casing (21) and the housing (50) are welded together. The first weld (Ma) is formed in the form of a dot at each of the locations of placement of the welding pins (Pa). Two or more of the first welds (Ma) are spaced at equal angular intervals along the circumferential direction (D) of the barrel casing (21). In addition, two or more of the first welds (Ma) are aligned along the axial direction (Z) of the barrel casing (21).

In this embodiment, the number of the welding pins (Pa) used is eight, and the number of the first welds (Ma) to be formed is eight corresponding to the number of the welding pins (Pa).

In this embodiment, the eight first welds (Ma) form four first weld groups (M). Each of the first weld groups (M) includes two of the first welds (Ma) aligned along the axial direction (Z) of the barrel casing (21). The four first weld groups (Ma) are aligned at intervals of 90 degrees along the circumferential direction (D) of the barrel casing (21).

The four first weld groups (M) include a first weld group (M1) and a first weld group (M2). The first weld groups (M1) and (M2) are spaced 180 degrees apart from each other along the circumferential direction (D) of the barrel casing (21).

As can be seen from the foregoing description, in this embodiment, the barrel casing (21) and the housing (50) are welded together through the four first weld groups (M).

Figure 6:
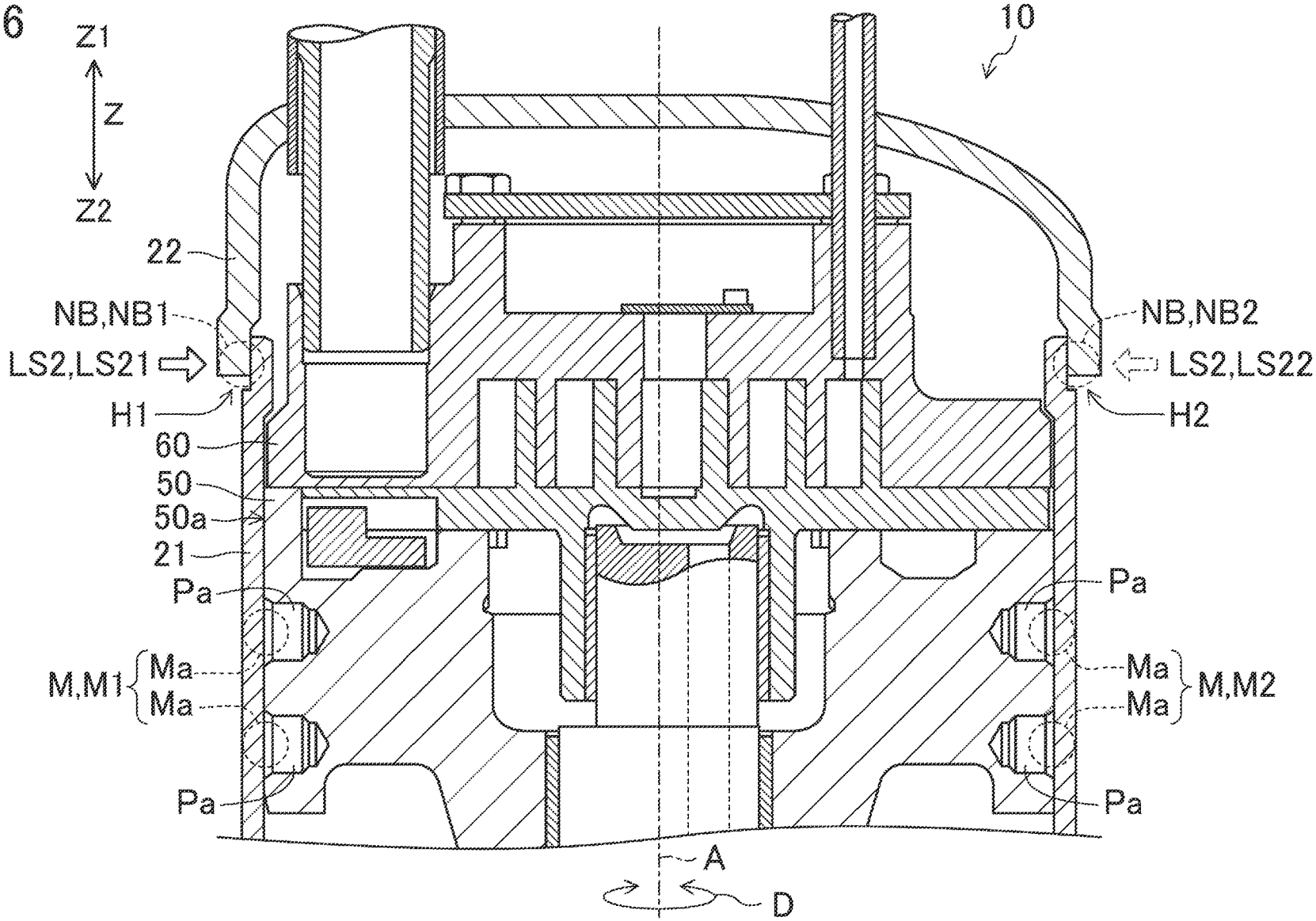
FIG. 6 is a cross-sectional view of a scroll compressor showing a procedure to weld the barrel casing and a first end casing together.
Figure 7:
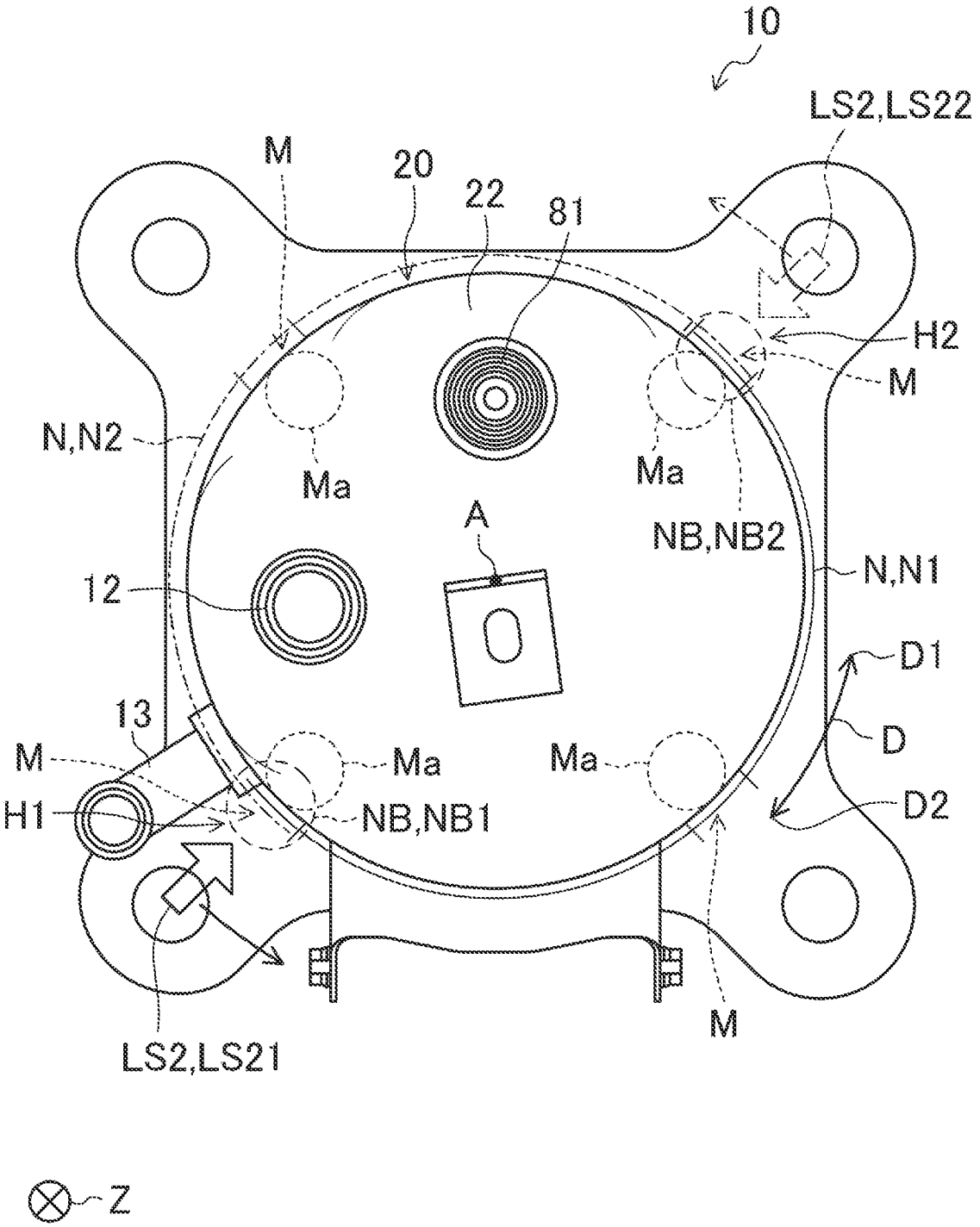
FIG. 7 is a schematic view of the scroll compressor illustrated in FIG. 6 as viewed from the axial direction of the barrel casing.

Next, a procedure to weld the barrel casing (21) and the first end casing (22) together during manufacture of the scroll compressor (10) will be described with reference to FIGS. 6 and 7. FIG. 6 is a cross-sectional view of the scroll compressor (10) showing the procedure to weld the barrel casing (21) and the first end casing (22) together. FIG. 7 is a schematic view of the scroll compressor (10) illustrated in FIG. 6 as viewed from the axial direction (Z) of the barrel casing (21).

In FIG. 6, actually, the formation of the first welds (Ma) causes the welding pins (Pa) to melt. However, in order to briefly indicate the positions of the first welds (Ma) in comparison with the positions of the welding pins (Pa), the welding pins (Pa) intentionally remain illustrated in FIG. 6.

After the barrel casing (21) and the housing (50) have been welded together to form the first welds (Ma) (see FIGS.

4 and 5), the anti-rotation member (46), the movable scroll (70), and the fixed scroll (60) are sequentially placed on the housing (50). The fixed scroll (60) is fastened to the housing (50) through bolts (not shown). Thereafter, the first end casing (22) is placed to cover an end of the barrel casing (21), and the barrel casing (21) and the first end casing (22) are welded together.

As illustrated in FIGS. 6 and 7, while the upper end of the barrel casing (21) is inserted into the opening (22*a*) at the lower end of the first end casing (22) so that the upper end of the barrel casing (21) is coupled to the lower end of the first end casing (22), a coupling portion between the barrel casing (21) and the first end casing (22) is irradiated with laser light (LS2).

The coupling portion between the barrel casing (21) and the first end casing (22) will be described.

The coupling portion between the barrel casing (21) and the first end casing (22) represents a portion serving as the joint between the upper end of the barrel casing (21) and the lower end of the first end casing (22). The coupling portion between the barrel casing (21) and the first end casing (22) has an annular shape along the circumferential direction (D) of the barrel casing (21).

The coupling portion between the barrel casing (21) and the first end casing (22) is set to have a first predetermined area (H1) and a second predetermined area (H2). Each of the first and second predetermined areas (H1) and (H2) is located at a location aligned with any one of the plurality of welding pin groups (P) along the axial direction (Z) of the barrel casing (21). In this embodiment, the first predetermined area (H1) is located at a location aligned with the first weld group (M1) along the axial direction (Z), and the second predetermined area (H2) is located at a location aligned with the first weld group (M2) along the axial direction (Z). In other words, in this embodiment, as viewed from the axial direction (Z) of the barrel casing (21), the position of the first predetermined area (H1) in the circumferential direction (D) of the barrel casing (21) substantially matches that of the first weld group (M1), and the position of the second predetermined area (H2) in the circumferential direction (D) of the barrel casing (21) substantially matches that of the first weld group (M2).

A procedure to irradiate the coupling portion between the barrel casing (21) and the first end casing (22) with the laser light (LS2) will be described.

The laser light (LS2) includes first laser light (LS21) and second laser light (LS22).

After the first predetermined area (H1) initially starts being irradiated with the first laser light (LS21), the first laser light (LS21) moves toward one side (D1) in the circumferential direction (D) of the barrel casing (21), and is thus continuously applied to a region from the first predetermined area (H1) to the second predetermined area (H2). The second predetermined area (H2) is 180° apart from the first predetermined area (H1) in the circumferential direction (D) of the barrel casing (21).

After the second predetermined area (H2) initially starts being irradiated with the second laser light (LS22), the second laser light (LS22) moves toward the one side (D1) in the circumferential direction (D) of the barrel casing (21), and is thus continuously applied to a region from the second predetermined area (H2) to the first predetermined area (H1).

A half portion of the coupling portion between the barrel casing (21) and the first end casing (22) is welded with the first laser light (LS21), and the remaining half portion of the coupling portion is welded with the second laser light (LS22).

A second weld (N) is formed on the area welded with each of the first laser light (LS21) and the second laser light (LS22).

The second welds (N) are each formed by welding the barrel casing (21) and the first end casing (22) together in the circumferential direction (D) of the barrel casing (21) over a predetermined length. The predetermined length is determined in accordance with the positions of repeatedly welded portions (NB), which will be described later.

Each of the second welds (N) is obtained by solidifying a member molten while the coupling portion between the barrel casing (21) and the first end casing (22) is welded. In this embodiment, the upper end of the barrel casing (21) and the lower end of the first end casing (22) melt and solidify to form the second welds (N).

One of the second welds (N) formed on the area irradiated with the first laser light (LS21) is hereinafter referred to as the "second weld (N1)." The other one of the second welds (N) formed on the area irradiated with the second laser light (LS22) is hereinafter referred to as the "second weld (N2)."

The second weld (N1) has a substantially semicircular arc shape. The second weld (N1) is formed on a region located from the first predetermined area (H1) toward the one side (D1) in the circumferential direction (D) of the barrel casing (21) to the second predetermined area (H2).

The second weld (N2) has a substantially semicircular arc shape. The second weld (N2) is formed on a region located from the second predetermined area (H2) toward the one side (D1) in the circumferential direction (D) of the barrel casing (21) to the first predetermined area (H1).

When the second weld (N2) is formed, the repeatedly welded portions (NB) are formed on the areas again irradiated with the laser light (LS2). The repeatedly welded portions (NB) protrude beyond, or become thicker than, a portion of the second weld (N2) except the repeatedly welded portions (NB). Thus, an operator can easily recognize the positions of the repeatedly welded portions (NB). If the ends of the second weld (N2) overlap each other as viewed from the radial direction of the barrel casing (21), the repeatedly welded portions (NB) protrude. If the ends of the second weld (N2) are misaligned without overlapping each other, the repeatedly welded portions (NB) become thicker.

In this embodiment, the repeatedly welded portions (NB) include a repeatedly welded portion (NB1) and a repeatedly welded portion (NB2).

The repeatedly welded portion (NB1) is a portion in which the welding start area where welding for the second weld (N1) is started and the welding end area where welding for the second weld (N2) ends overlap each other. In this embodiment, the repeatedly welded portion (NB1) is formed on the first predetermined area (H1).

The repeatedly welded portion (NB2) is a portion where the welding end area where welding for the second weld (N1) ends and the welding start area where welding for the second weld (N2) is started overlap each other. In this embodiment, the repeatedly welded portion (NB2) is formed on the second predetermined area (H2).

In this embodiment, the repeatedly welded portions (NB1) and (NB2) are formed at locations 180° apart from each other along the circumferential direction (D) of the barrel casing (21).

Each of the repeatedly welded portions (NB1) and (NB2) is formed at a location aligned with any one of the plurality of first weld groups (M) along the axial direction (Z) of the barrel casing (21). In this embodiment, the repeatedly welded portion (NB1) is aligned with the first weld group (M1) along the axial direction (Z) of the barrel casing (21), and the repeatedly welded portion (NB2) is aligned with the first weld group (M2) along the axial direction (Z) of the barrel casing (21). In other words, in this embodiment, as viewed from the axial direction (Z) of the barrel casing (21), the position of the repeatedly welded portion (NB1) in the circumferential direction (D) of the barrel casing (21) substantially matches that of the first weld group (M1), and the position of the repeatedly welded portion (NB2) in the circumferential direction (D) of the barrel casing (21) substantially matches that of the second weld group (M2).

A situation where portions are aligned along the axial direction (Z) of the barrel casing (21) indicates, in other words, that the portions have the same rotational angle in the circumferential direction (D) of the barrel casing (21) as viewed from the axial direction (Z) of the barrel casing (21).

Structures in each of which any one of the plurality of repeatedly welded portions (NB) and any one of the plurality of first welds (Ma) are aligned along the axial direction (Z) of the barrel casing (21) may be hereinafter referred to as the "array structures." The number of the array structures is two or more, and the array structures are aligned at equal angular intervals along the circumferential direction (D) of the barrel casing (21). In this embodiment, the two array structures are spaced 180° apart from each other along the circumferential direction (D) of the barrel casing (21). The two array structures of this embodiment include a first array structure including the repeatedly welded portion (NB1) and the first weld group (M1), and a second array structure including the repeatedly welded portion (NB2) and the first weld group (M2).

As can be seen from the foregoing description, the barrel casing (21) and the first end casing (22) are welded together through the second welds (N1) and (N2), and are thus joined together over the entire circumference of the barrel casing (22). When the barrel casing (21) and the first end casing (22) are welded together through the second welds (N1) and (N2), the array structures each including the above-described repeatedly welded portion (NB) and the associated first welds (Ma) are formed.

Figure 8:
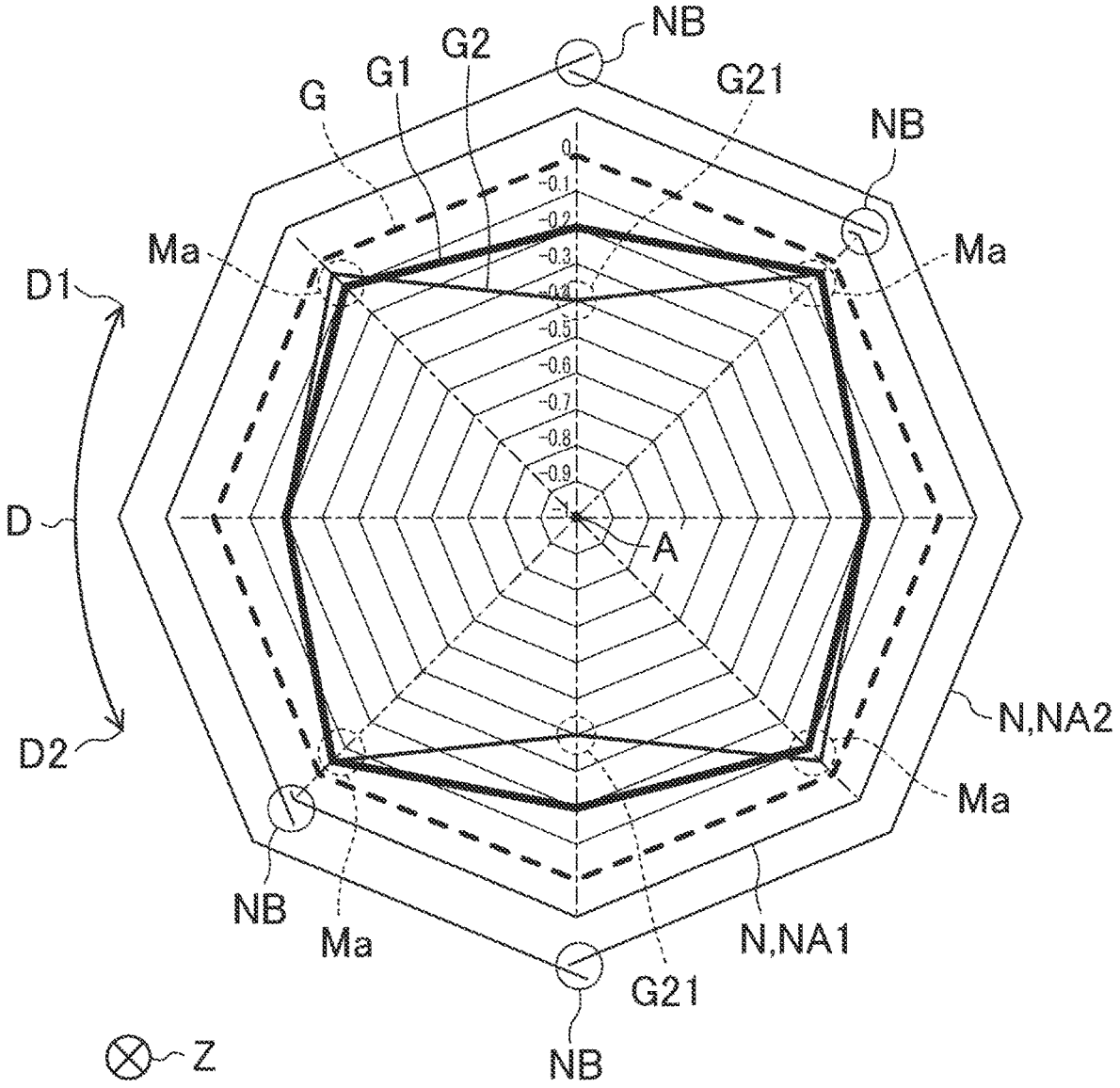
FIG. 8 is a conceptual diagram showing the results of an experiment.

The results of an experiment performed to study contraction of the barrel casing (21) during manufacture of the scroll compressor (10) will be described with reference to FIG. 8. FIG. 8 is a conceptual diagram showing the results of the experiment. The inventors of this application conducted the experiment to acquire the results of the experiment shown in FIG. 8.

First, the background of the experiment performed by the inventors of this application will be described.

If the scroll compressor (10) is reduced in size, the clearance (C) between the outer peripheral surface (60*a*) of the fixed scroll (60) and the inner peripheral surface (21*c*) of the barrel casing (21) (see FIG. 2) may be designed to be small to achieve both a reduction in the size of the scroll compressor (10) and the securing of the sealing performance. However, if the clearance (C) is designed to be small, and the barrel casing (21) contracting during manufacture of the scroll compressor (10) causes the size of the clearance (C) to be smaller than the intended size thereof, the outer peripheral surface (60*a*) of the fixed scroll (60) is more likely to be in contact with the inner peripheral surface (21*c*) of the barrel casing (21). If the outer peripheral surface (60*a*) of the fixed scroll (60) comes into contact with the inner peripheral surface (21*c*) of the barrel casing (21), problems, such as noise generation and deformation of the fixed scroll (60), may be caused during manufacture of the scroll compressor (10). To address these problems, the inventors of this application determined the cause of the contraction of the barrel casing (21) during manufacture of the scroll compressor (10), and further conducted the experiment to derive a solution.

Next, the results of the experiment will be described with reference to FIG. 8.

The inventors of this application adopted a first condition for one of two barrel casings (21) to form a second weld (N). The inventors of this application adopted a second condition for the other one of the two barrel casings (21) to form another second weld (N). The inventors of this application conducted an experiment to compare the degrees of contraction of the barrel casings (21) to each other.

The second weld (N) formed through the adoption of the first condition is hereinafter referred to as the "second weld (NA1)," and the second weld (N) formed through the adoption of the second condition is hereinafter referred to as the "second weld (NA2)."

The first condition indicates a condition where the second weld (NA1) is formed such that each of the repeatedly welded portions (NB) of the second weld (NA1) and the associated first weld (Ma) are aligned along the axial direction (Z) of the barrel casing (21).

The second condition indicates a condition where the second weld (NA2) is formed such that each of the repeatedly welded portions (NB) of the second weld (NA2) and the associated first weld (Ma) are not aligned along the axial direction (Z) of the barrel casing (21). In the present experiment, the repeatedly welded portions (NB) of the second weld (NA2) are formed at locations 45 degrees apart from the associated first welds (Ma) in the circumferential direction (D) of the barrel casing (21).

In FIG. 8, the outer shape (G) shown by the dotted lines is a schematic view of the shape of an outer peripheral portion of the barrel casing (21) before the formation of the second weld (N) (before contraction), as viewed from the axial direction (Z) of the barrel casing (21). In FIG. 8, the outer shape (G) is polygonal for convenience. However, actually, the outer shape (G) is substantially circular. FIG. 8 shows the amount of deformation of the outer shape (G) into each of outer shapes (G1) and (G2), but shows the amount of deformation in an exaggerated manner.

The outer shape (G1) shown by the thick lines is a schematic view of the shape of the outer peripheral portion of the barrel casing (21) that has been formed with the second weld (NA1) under the first condition, as viewed from the axial direction (Z) of the barrel casing (21). FIG. 8 illustrates the second weld (NA1) outside the outer shape (G1) for convenience of illustration. However, actually, the second weld (NA1) is shaped to substantially overlap the outer shape (G1) as viewed from the axial direction (Z) of the barrel casing (21). In this case, the repeatedly welded portions (NB) of the second weld (NA1) substantially overlap portions of the outer shape (G1) formed with the associated first welds (Ma).

The outer shape (G2) shown by the thin lines is a schematic view of the shape of the outer peripheral portion of the barrel casing (21) that has been formed with the second weld (NA2) under the second condition, as viewed from the axial direction (Z) of the barrel casing (21). FIG. 8 illustrates the second weld (NA2) outside the outer shape (G2) for convenience of illustration. However, actually, the second weld (NA2) is shaped to substantially overlap the outer shape (G2) as viewed from the axial direction (Z) of the barrel casing (21). In this case, the repeatedly welded portions (NB) of the second weld (NA2) substantially overlap associated recesses (G21) of the outer shape (G2) recessed inward in the radial direction of the barrel casing (21).

As illustrated in FIG. 8, both the outer shapes (G1) and (G2) are more contracted than the outer shape (G). Thus, the inventors of this application found that when each of the second welds (NA1) and (NA2) is to be formed, the barrel casing (21) contracts by heat for welding.

Further, the repeatedly welded portions (NB) double-heated cause heat to be more additionally applied to these portions than to other welded portions (single-heated portions). Thus, the inventors of this application found that the contractile force acting on the barrel casing (21) increases in the vicinity of the repeatedly welded portions (NB) (see the concave portions (G21) of the barrel casing (21)).

As illustrated in FIG. 8, the degree to which the outer shape (G) contracts to form each of the outer shapes (G1) and (G2) is low in the vicinity of the first welds (Ma). Thus, the inventors of this application found that the first welds (Ma) function as stiffener members to enable the barrel casing (21) to have sufficiently high rigidity.

A situation where the first welds (Ma) function as stiffener members indicates, in other words, that the welding pins (Pa) function as stiffener members.

As illustrated in FIG. 8, the degree of contraction of the outer shape (G) to the outer shape (G1) formed through the adoption of the first condition is lower than that to the outer shape (G2) formed through the adoption of the second condition. Thus, the inventors of this application found that adopting the first condition allows the sufficiently high rigidity provided by the first welds (Ma) to act more effectively on the repeatedly welded portions (NB) with greater contractile force, and thus more effectively reduces contraction of the barrel casing (21), than adopting the second condition.

Advantages of Embodiment

As described above with reference to FIGS. 1 to 8, each repeatedly welded portion (NB) and the associated first weld (Ma) are aligned along the axial direction (Z) of the barrel casing (21) (see FIG. 6). This allows the sufficiently high rigidity provided by the first welds (Ma) to act effectually on the repeatedly welded portions (NB). As a result, the deformation of the barrel casing (21) can be reduced. Thus, the clearance (C) between the outer peripheral surface (60*a*) of the fixed scroll (60) and the inner peripheral surface (21*c*) of the barrel casing (21) (see FIG. 2) can be effectively secured.

In addition, if the repeatedly welded portions (NB) are formed such that each of the repeatedly welded portions (NB) and the associated first weld (Ma) are aligned along the axial direction (Z) of the barrel casing (21), a difference can be substantially prevented from being created between the degree of contraction of the portions of the barrel casing (21) formed with the repeatedly welded portions (NB) (double-welded portions) and the degree of contraction of other portions of the barrel casing (21) (single-welded portions) during providing of the second welds (N). As a result, the degree of contraction (strain) of the barrel casing (22) can be substantially uniformized over the entire circumference of the barrel casing (22), irrespective of where the repeatedly welded portions (NB) are formed.

Further, as illustrated in FIG. 7, simultaneously performing the process of forming the second weld (N1) through irradiation with the first laser light (LS21) and the process of forming the second weld (N2) through irradiation with the second laser light (LS22) can shorten the time required to weld the barrel casing (21) and the first end casing (22) together. As a result, the barrel casing (21) and the first end casing (22) can be efficiently welded together.

While the embodiments and the variations thereof have been described above, it will be understood that various changes in form and details may be made without departing from the spirit and scope of the claims (e.g., (1) to (5)). The embodiments and the variations thereof may be combined and replaced with each other without deteriorating intended functions of the present disclosure.

(1) In this embodiment, the eight first welds (Ma) are formed (see FIGS. 4 and 5). However, the number of the first welds (Ma) is not specifically limited. For example, the number of the first welds (Ma) formed does not need to be eight, and merely needs to be two or more.

Alternatively, one first weld (Ma) may be formed. In this case, a repeatedly welded portion (NB) is formed at a location aligned with the one first weld (Ma) along the axial direction (Z) of the barrel casing (21). In this case, one second weld (N) is formed. An area of the one second weld (N) where welding is started and an area thereof where welding ends are both repeatedly welded portions (NB). The one second weld (N) is formed around the coupling portion between the barrel casing (21) and the first end casing (22) in the circumferential direction (D).

(2) In this embodiment, a plurality of first welds (Ma) are formed so as to be aligned at equal angular intervals (intervals of 90 degrees) along the circumferential direction (D) of the barrel casing (21) (see FIG. 5). Thus, the plurality of first welds (Ma) is formed symmetrically about the axis (A) of the barrel casing (21). This allows the scroll compressor (10) to be effectively weight-balanced. As a result, the relative displacement of the housing (50) with respect to the barrel casing (21) can be reduced.

However, the present invention is not limited to this. The intervals between adjacent pairs of the plurality of first welds (Ma) in the circumferential direction (D) are not specifically limited, but do not have to be equal. This can improve the degree of freedom in the design of the scroll compressor (10).

(3) In this embodiment, each first weld group (M) is configured such that two of the first welds (Ma) are aligned along the axial direction (Z) of the barrel casing (21) (see FIG. 6). This allows the first welds (Ma) to function effectively and reliably as stiffener members. However, the present invention is not limited to this.

Each first weld group (M) may include three or more of the first welds (Ma) aligned along the axial direction (Z) of the barrel casing (21). This allows the barrel casing (21) to effectively have sufficiently high rigidity. Alternatively, each first weld group (M) may include one of the first welds (Ma). Thus, the process of welding the barrel casing (21) and the housing (50) together can be promptly performed.

(4) In this embodiment, the welding pins (Pa) are press-fitted into the housing (50), and then are molten, thereby welding the barrel casing (21) and the housing (50) together. However, the present invention is not limited to this. For example, the barrel casing (21) may have a through hole formed at a location facing the housing (50). A first filler metal molten may be supplied into the through hole, and then may be solidified to weld the barrel casing (21) and the housing (50) together. In this case, the solidified first filler metal constitutes the first weld (Ma).

(5) In this embodiment, the coupling portion between the barrel casing (21) and the first end casing (22) is molten with the laser light (LS2), and is then solidified, thereby welding the barrel casing (21) and the first end casing (22) together. However, the present invention is not limited to this. A second filler metal molten may be supplied to the coupling portion between the barrel casing (21) and the first end casing (22), and the supplied second filler metal may be solidified to weld the barrel casing (21) and the first end casing (22) together. In this case, the solidified second filler metal constitutes the second weld (N).

As can be seen from the foregoing description, the present disclosure is useful for a compressor and a method for manufacturing a compressor.

The invention claimed is:

1. A compressor, comprising:

a casing including a tubular barrel casing and an end casing covering an opening of an end portion of the tubular barrel casing;

a housing provided inside the casing;

a first weld formed by welding the tubular barrel casing and the housing together; and a second weld formed by welding the tubular barrel casing and the end casing together over a predetermined length along a circumferential direction of the tubular barrel casing, the second weld including a repeatedly welded portion formed by one end portion and an other end portion of the second weld overlapping each other, or the second weld including a plurality of second welds each including a repeatedly welded portion formed by an end portion of the second weld and an end portion of an other one of the second welds overlapping each other, the repeatedly welded portion being formed to reduce deformation of the tubular barrel casing, and the repeatedly welded portion and the first weld being aligned along an axial direction of the tubular barrel casing, with respect to the circumferential direction of the barrel casing, a width of the repeatedly welded portion to a width of the first weld aligned with the repeatedly welded portion along the axial direction, the width of the repeatedly welded portion is larger than or equal to the width of the first weld, and the formed second weld being a single second weld having a substantially circular shape or a pair of second welds each having a substantially semicircular arc shape.

2. The compressor of claim 1, wherein the repeatedly welded portion protrudes beyond, or is thicker than, a portion of the second weld except the repeatedly welded portion.

3. The compressor of claim 2, wherein the first weld includes a plurality of first welds aligned at equal angular intervals along the circumferential direction of the tubular barrel casing.

4. The compressor of claim 3, wherein the first weld includes a plurality of first welds aligned along the axial direction of the tubular barrel casing.

5. The compressor of claim 2, wherein the first weld includes a plurality of first welds aligned along the axial direction of the tubular barrel casing.

6. The compressor of claim 1, wherein the first weld includes a plurality of first welds aligned at equal angular intervals along the circumferential direction of the tubular barrel casing.

7. The compressor of claim 6, wherein the first weld includes a plurality of first welds aligned along the axial direction of the tubular barrel casing.

8. The compressor of claim 1, wherein the first weld includes a plurality of first welds aligned along the axial direction of the tubular barrel casing.

9. A compressor comprising:

a casing including a tubular barrel casing and an end casing covering an opening of an end portion of the tubular barrel casing;

a housing provided inside the casing;

a first weld formed by welding the tubular barrel casing and the housing together; and a second weld formed by welding the tubular barrel casing and the end casing together over a predetermined length along a circumferential direction of the tubular barrel casing, the second weld including a repeatedly welded portion formed by one end portion and an other end portion of the second weld overlapping each other, or the second weld including a plurality of second welds each including a repeatedly welded portion formed by an end portion of the second weld and an end portion of an other one of the second welds overlapping each other, the repeatedly welded portion being formed to reduce deformation of the tubular barrel casing, and the repeatedly welded portion and the first weld being aligned along an axial direction of the tubular barrel casing, the first weld including a plurality of first welds, and the repeatedly welded portion includes a plurality of repeatedly welded portions, a plurality of array structures each including any one of the plurality of first welds and any one of the plurality of repeatedly welded portions aligned along the axial direction of the tubular barrel casing, and the plurality of array structures being aligned at equal angular intervals along the circumferential direction of the tubular barrel casing.

10. The compressor of claim 9, wherein the repeatedly welded portion protrudes beyond, or is thicker than, a portion of the second weld except the repeatedly welded portion.

11. The compressor of claim 9, wherein the first weld includes a plurality of first welds aligned at equal angular intervals along the circumferential direction of the tubular barrel casing.

12. The compressor of claim 9, wherein the repeatedly welded portion protrudes beyond, or is thicker than, a portion of the second weld except the repeatedly welded portion, and the first weld includes a plurality of first welds aligned at equal angular intervals along the circumferential direction of the tubular barrel casing.

13. The compressor of claim 9, wherein the first weld includes a plurality of first welds aligned along the axial direction of the tubular barrel casing.

14. The compressor of claim 9, wherein the repeatedly welded portion protrudes beyond, or is thicker than, a portion of the second weld except the repeatedly welded portion, and the first weld includes a plurality of first welds aligned along the axial direction of the tubular barrel casing.

15. The compressor of claim 9, wherein the first weld includes a plurality of first welds aligned at equal angular intervals along the circumferential direction of the tubular barrel casing, and the first weld includes a plurality of first welds aligned along the axial direction of the tubular barrel casing.

16. The compressor of claim 9, wherein the repeatedly welded portion protrudes beyond, or is thicker than, a portion of the second weld except the repeatedly welded portion, the first weld includes a plurality of first welds aligned at equal angular intervals along the circumferential direction of the tubular barrel casing, and the first weld includes a plurality of first welds aligned along the axial direction of the tubular barrel casing.

17. A method for manufacturing a compressor, the method comprising:

housing a housing inside a tubular barrel casing;

welding the tubular barrel casing and the housing together to form a first weld; and circumference welding the tubular barrel casing and an end casing together from a predetermined welding start area along a circumferential direction of the tubular barrel casing so as to reduce deformation of the tubular barrel casing to form a second weld, by which the tubular barrel casing and the end casing are joined together over an entire circumference of the tubular barrel casing, the end casing covering an opening of an end portion of the tubular barrel casing, the predetermined welding start area being located at a location aligned with the first weld along an axial direction of the tubular barrel casing, and end portions welded overlapping each other at the predetermined welding start area, with respect to the circumferential direction of the barrel casing, a width of the second weld to a width of the first weld aligned with the second weld along the axial direction, the width of the second weld is larger than or equal to the width of the first weld, and the formed second weld being a single second weld having a substantially circular shape or a pair of second welds each having a substantially semicircular arc shape.

18. The method of claim 17, wherein the welding start area includes a first welding start area and a second welding start area, and the circumference welding includes welding the end portion of the tubular barrel casing and the end casing together from the first welding start area to a predetermined first welding end area along the circumferential direction of the tubular barrel casing, and welding the end portion of the tubular barrel casing and the end casing together from the second welding start area to a predetermined second welding end area along the circumferential direction of the tubular barrel casing.

19. The method of claim 18, wherein the first welding end area matches the second welding start area, and the second welding end area matches the first welding start area.

* * * * *